US005259795A

United States Patent [19]

Yamada et al.

[11] Patent Number: 5,259,795

[45] Date of Patent: Nov. 9, 1993

[54] EDGE CONNECTOR FOR A PRINTED CIRCUIT BOARD OR THE LIKE

[75] Inventors: Shoji Yamada, Machida; Yoshihisa Yamamoto, Kanagawa; Hideyuki Hirata, Yokohama, all of Japan

[73] Assignee: Molex Incorporated, Lisle, Ill.

[21] Appl. No.: 934,064

[22] Filed: Aug. 21, 1992

[30] Foreign Application Priority Data

Apr. 18, 1992 [JP] Japan ..... 4-125528

[51] Int. Cl.[5] ..... H01R 13/42

[52] U.S. Cl. ..... 439/751; 439/637

[58] Field of Search ..... 439/326, 327, 328, 630–637, 439/62, 65, 741, 751, 873

[56] References Cited

U.S. PATENT DOCUMENTS

| | | | |
|---|---|---|---|
| 3,617,992 | 11/1971 | Rhuelemann et al. | 439/631 |
| 3,631,381 | 12/1971 | Pittman | 439/637 |
| 3,732,531 | 5/1973 | Bouley | 339/217 R |
| 4,722,700 | 2/1988 | Kuhn et al. | 439/629 |
| 4,725,250 | 2/1988 | Kuhn et al. | 439/629 |
| 4,960,386 | 10/1990 | Stanevich | 439/326 |
| 4,973,270 | 11/1990 | Billman et al. | 439/630 |
| 4,990,107 | 2/1991 | Fortuna | 439/637 |
| 5,082,459 | 1/1992 | Billman et al. | 439/637 |
| 5,104,324 | 4/1992 | Grabbe et al. | 439/62 |

OTHER PUBLICATIONS

Molex Drawing No. 52399-***0.

*Primary Examiner*—David L. Pirlot

*Attorney, Agent, or Firm*—Charles S. Cohen

[57] ABSTRACT

An edge connector is adapted for use with a printed circuit board having a mating edge and a plurality of contact pads on opposite sides of the board adjacent the edge. The connector includes an elongated dielectric housing having a slot for receiving the mating edge of the printed circuit board. A plurality of terminals are mounted on the housing along the slot. Each terminal includes a pair of side support portions fixed to the housing generally near opposite sides of the slot, a cross brace portion extending between the side support portions, a terminating portion projecting below the cross brace portion and a spring contact portion projecting above the cross brace portion for engaging one of the contact pads on the printed circuit board. The spring contact portion extends from one side of the terminal across the slot for engaging a contact pad on an opposite side of the printed circuit board. The terminals are oriented in an alternating array along the slot whereby the spring contact portions alternatingly engage contact pads on opposite sides of the printed circuit board. The housing includes an area supportingly engaging the underside of the cross brace portion to resist rotational movement of the terminal as the printed circuit board biases the spring contact portion transversely of the slot.

20 Claims, 2 Drawing Sheets

11
22a
32
32
24
10
32
12
22b
18

EDGE CONNECTOR FOR A PRINTED CIRCUIT BOARD OR THE LIKE

FIELD OF THE INVENTION

This invention generally relates to the art of electrical connectors and, particularly, to a high density edge connector for a printed circuit board.

BACKGROUND OF THE INVENTION

A popular type of electrical connector which is used widely in the electronic industry is called an "edge card" connector. An edge connector is provided for receiving a printed circuit board having a mating edge and a plurality of contact pads adjacent the edge. Such edge connectors have an elongated housing defining an elongated receptacle or slot for receiving the mating edge of the printed circuit board. A plurality of terminals are spaced along one or both sides of the slot for engaging the contact pads adjacent the mating edge of the board. In many applications, such edge connectors are mounted on a second printed circuit board. The mating edge board or card commonly is called the "daughter" board, and the board to which the connector is mounted commonly is called the "mother" board.

One of the problems with edge connectors of the character described above centers around the ever-increasing miniaturization of such connectors brought about because of the demands for high density electronic circuitry. The terminals of such a connector are mounted in a housing fabricated of dielectric material such as plastic or the like. Not only are the terminals becoming ever-increasingly miniaturized, but the dimensions of the housing are becoming smaller and smaller. The terminals are mounted in rows along the slot of the housing, with the terminals being separated by a dielectric partition integral with the housing, and the housing includes side walls for surrounding the terminals. The parameters of providing a very high density connector, in combination with the increasing miniaturization of the connectors, results in the housing portions between and around the terminals becoming extremely thin. Not only does this result in the housing portions potentially providing insufficient support for the terminals, but the stresses placed on the terminals due to their engagement with an inserted circuit board may result in the housing becoming warped, bent, or otherwise disfigured.

This invention is directed to solving the above problems by providing a combination of a particular terminal configuration along with its mounting orientation and support provided by surrounding portions of the housing to provide a sturdy and reliable edge connector capable of high density applications in miniaturized or compact environments.

SUMMARY OF THE INVENTION

An object, therefore, of the invention is to provide a new and improved edge connector for a printed circuit board.

In particular, the invention is directed to applications wherein the printed circuit board has a mating edge and a plurality of contact pads on opposite sides of the board adjacent the edge.

In the exemplary embodiment of the invention, the edge connector includes an elongated dielectric housing having a board-receiving slot means for receiving the mating edge of the printed circuit board. A plurality of terminals are mounted on the housing. Each terminal includes a pair of side support portions fixed to the housing generally near opposite sides of the slot means. A cross brace portion extends between the side support portions. A terminating portion projects below the cross brace portion for rigid securement to a complementary circuit component such as a mother board. A spring contact portion projects above the cross brace portion for engaging one of the contact pads on the printed circuit board. The spring contact portion extends from one side of the terminal, across the slot means, for engaging a contact pad on an opposite side of the printed circuit board.

The invention contemplates that the above configuration of the terminals be employed in the connector in such a manner as to be oriented in an alternating array along the slot means of the elongated housing, whereby the contact portions of the terminals alternatingly engage contact pads on opposite sides of the printed circuit board. It is contemplated that the housing includes an area supportingly engaging the underside of the cross brace portion of each terminal to resist rotational movement of the terminal as the printed circuit board biases the spring contact portion thereof transversely of the slot means.

As disclosed herein, the side support portions of each terminal comprise legs projecting below the cross brace portion of the terminals. The legs are fixed within holes in the housing. At least one of the legs projects at least below a bottom surface of the housing to define the terminating portion of the terminal. At least one of the legs projects above the cross brace portion, and the spring contact portion of the terminal extends from the one leg, above the cross brace portion, across the slot means. In the preferred embodiment of the invention, both legs of the terminal project above the cross brace portion for facilitating top loading of the terminal into the housing through the slot means.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings in which like reference numerals identify like elements in the figures and in which:

DETAILED DESCRIPTION OF THE PREFERRED EMBODIMENT

Figure 1:
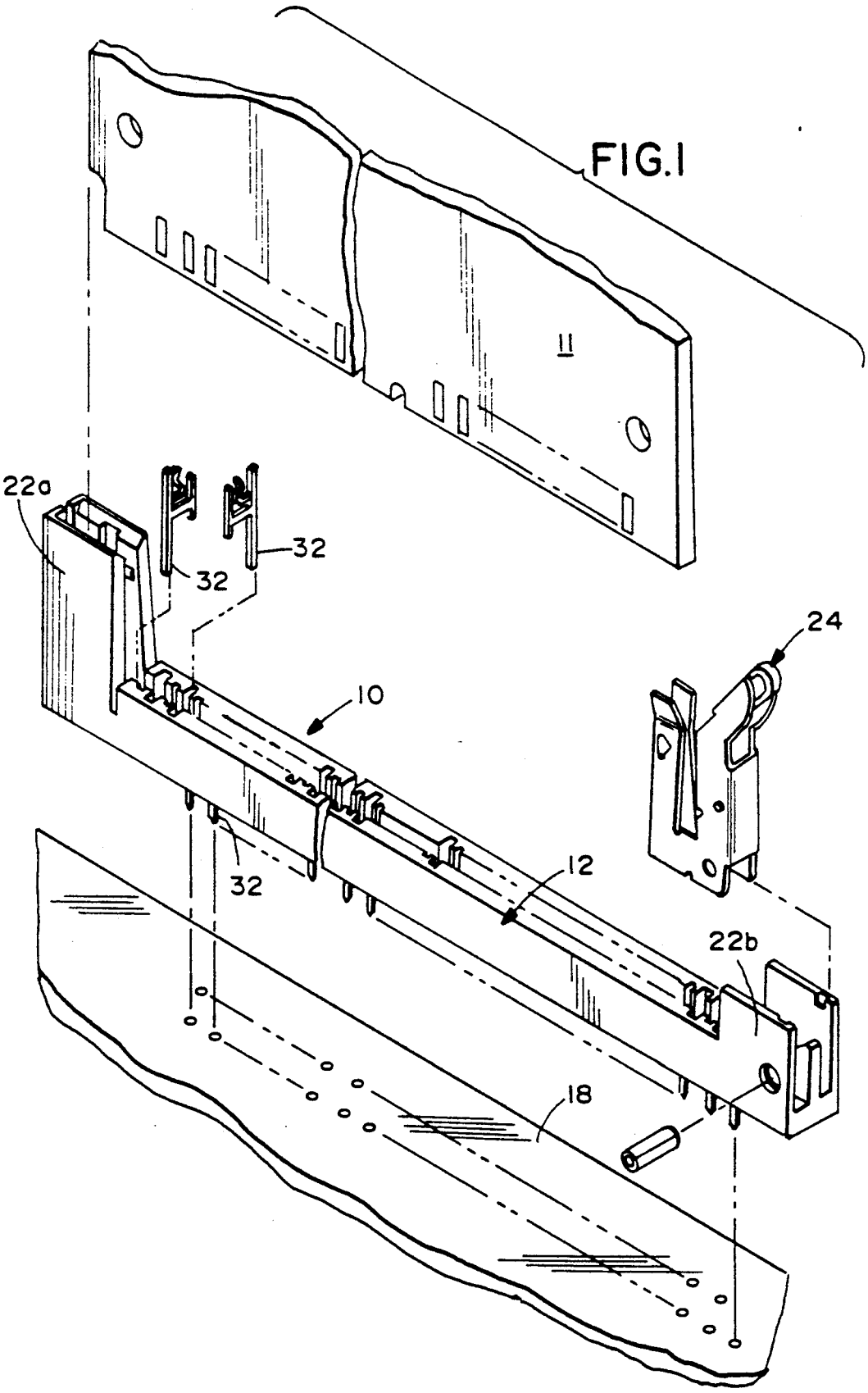
FIG. 1 is an exploded perspective view of an edge connector embodying the concepts of the invention.
Figure 2:
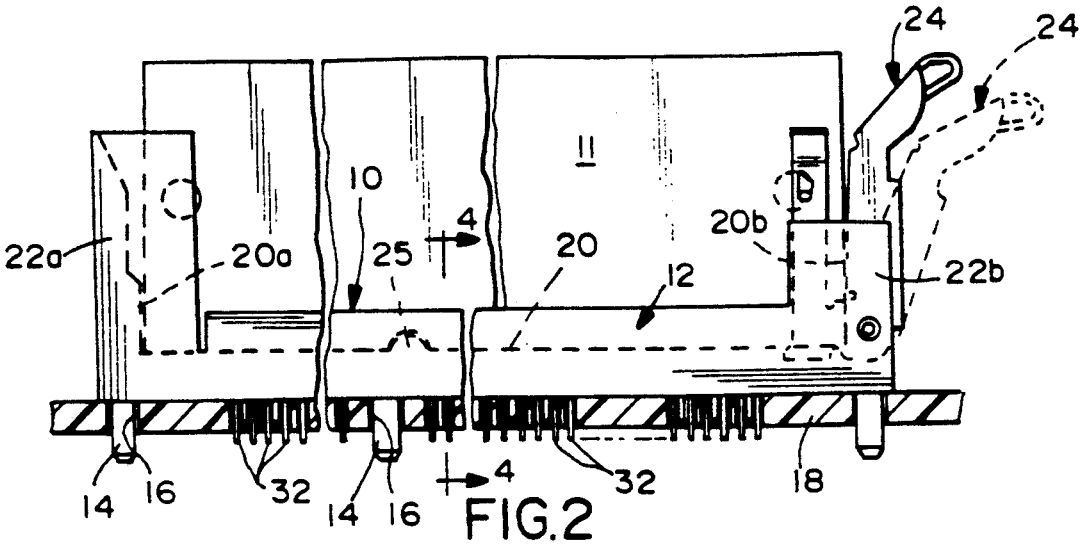
FIG. 2 is a side elevational view of the edge connector of FIG. 1.
Figure 3:
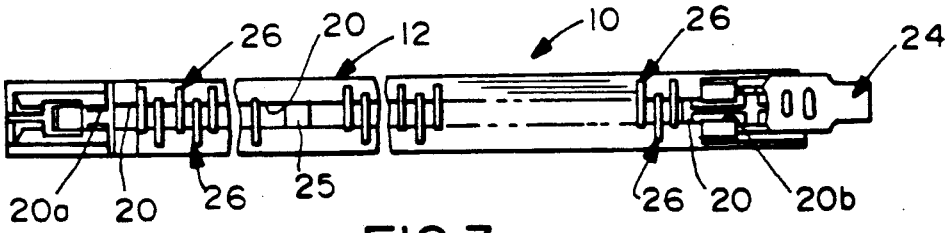
FIG. 3 is a top plan view of the edge connector of FIG. 1.

Referring to the drawings in greater detail, and first to FIGS. 1-3, an edge connector, generally designated 10, is shown for use with a printed circuit board 11. As is conventional with edge connectors, the printed circuit board has a mating edge and a plurality of contact pads adjacent the edge. With edge connector 10 of this invention, printed circuit board 11 will have a mating edge and a plurality of contact pads 40 on both sides of the board adjacent the edge. This printed circuit board commonly is called the "daughter" board. In the present configuration, the contact pads on one side of the board are offset from the contact pads on the other side.

Edge connector 10 includes an elongated dielectric housing, generally designated 12, which is fabricated of plastic material or the like. The housing has a plurality of depending mounting pegs 14 (FIG. 2) for insertion into appropriate mounting holes 16 in a second printed circuit board 18. This printed circuit board commonly is called the "mother" board, whereby edge connector 10 is effective to electrically couple circuitry of daughter board 11, through its mating edge, with circuitry of mother board 18.

Still referring to FIGS. 1-3, elongated housing 12 of edge connector 10 is integrally molded of the dielectric material and includes a board-receiving slot means 20 for receiving the mating edge of the daughter board. The slot extends, as at 20*a* and 20*b*, outwardly and upwardly into a pair of upstanding post portions 22*a* and 22*b*, respectively, of the housing. Although not forming part of the invention, the connector includes an ejecting mechanism, generally designated 24, which is movable between the full-line position shown in FIG. 2 to an ejecting position, shown in phantom, in order to eject the daughter board from the connector, specifically from slot 20. The housing has a polarizing boss 25 which is offset from a mid-point of the elongated housing for engaging in a complementary polarizing recess in the mating edge of daughter board 11 and which also is similarly offset from a mid-point of the board.

Before proceeding further, it must be understood that such terms as "top", "bottom", "above", "below", and the like, are used in the specification herein and in the claims hereof not in a limiting sense but in order to more clearly define the invention, it being understood that edge connector 10 is totally omni-directional in use or application.

Figure 5:
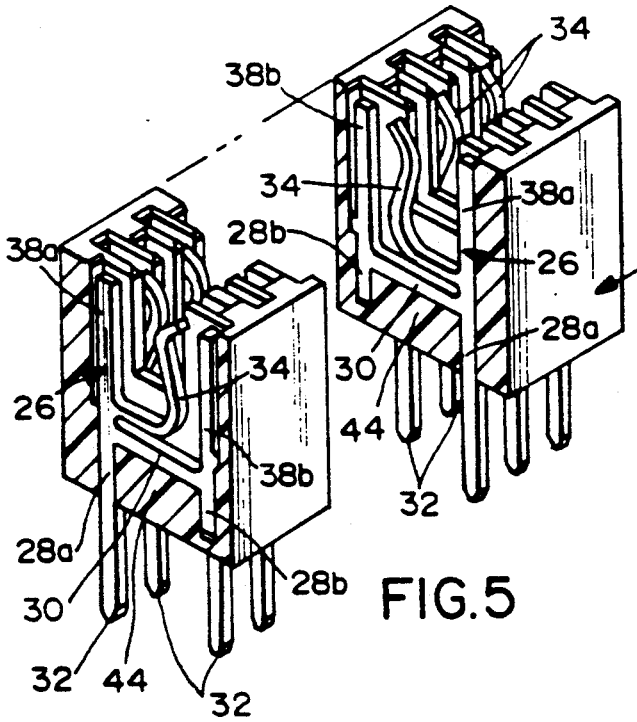
FIG. 5 is a fragmented perspective view of sections through the connector, as viewed generally in the direction of line 4—4 of FIG. 2.
Figure 4:
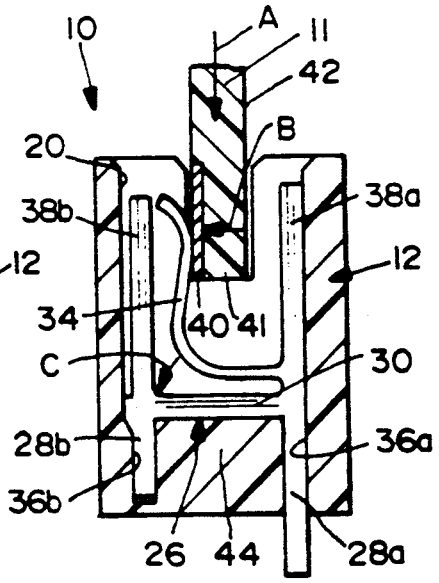
FIG. 4 is a section, on an enlarged scale, taken generally along the line 4—4 of FIG. 2.

Referring to FIGS. 4 and 5 in conjunction with FIGS. 1-3, a plurality of terminals, generally designated 26, are mounted on housing 12, generally within slot 20, and spaced longitudinally along the slot and housing for contacting daughter board 11 and terminating with mother board 18 in order to electrically interconnect the contact pads on the daughter board with the circuit traces on the mother board.

More particularly, each terminal 26 is edge blanked from sheet metal and includes a pair of side support portions 28*a* and 28*b*, a cross brace portion 30, a terminating portion 32 and a spring contact portion 34. Side support portions 28*a* and 28*b* are in the form of legs which are fixed to housing 12, within holes 36*a* and 36*b*, respectively, generally near opposite side of slot 20. Cross brace portion 30 extends between side support portions 28*a* and 28*b*. In the illustrated embodiment, terminating portion 32 is in the form of an extension of side support portion or leg 28*a* to form a solder tail for insertion into an appropriate hole in mother board 18 for interconnection with a circuit trace on the mother board or in the hole thereof. Side support portions or legs 28*a* and 28*b* project above cross brace portion 30, as at 38*a* and 38*b*, respectively. These leg extensions abut against side walls of housing 12 which define slot 20. The leg extensions are provided for facilitating top loading of the terminal into slot 20 of the housing. Lastly, spring contact portion 34 extends from one side of the terminal (namely, from side support portion 28*a*), across slot 20, for engaging a contact pad 40 (FIG. 3) on an opposite side 42 of daughter board 11 adjacent mating edge 41 of the board. In the alternative, spring contact portion 34 could extend from side support portion 28*b*.

The invention contemplates that housing 12 includes an area, as at 44 (FIG. 4), which supportingly engages the underside of cross brace portion 30 to resist rotational movement of the terminal as daughter board 11 biases spring contact portion 34 of the terminal transversely of slot 20. More particularly, when daughter board 11 is inserted into the connector in the direction of arrow "A" (FIG. 4), spring contact portion 34 is biased in the direction of arrow "B", resulting in an effective rotational moment of the terminal in the direction of arrow "C". Supporting area 44 of housing 12 resists this rotational moment by supportingly engaging the underside of cross brace portion 30. In addition, the interaction of the lower portion of side support 28*b* beneath cross brace 30 located within hole 36*b* further resists rotation of the terminal. Therefore, stresses on any other portions or areas of the housing are reduced, at least in the immediate surrounding area of each terminal 26. In essence, supporting area 44 of the housing is put under compression and resists the rotational moments caused by the terminal being biased by insertion of daughter board 11 against spring contact portion 34 of the terminal. As a result, the stresses on the housing are relatively well distributed which permits increased miniaturization of the housing.

The cooperative distribution of stresses afforded by the configuration of terminal 26 and the surrounding areas of housing 12, as described in relation to FIG. 4, are distributed lengthwise of the connector housing along slot 20 to further prevent distortion of the housing. More particularly, and with reference to FIG. 5, the invention contemplates that terminals 26 be oriented along slot 20 in an alternating array along the elongated housing. Therefore, it can be seen that the contact portions of the terminals, as alternatingly arrayed in FIG. 4, will be effective to alternatingly engage contact pads on opposite sides of daughter board 11. Consequently, the directions of the stresses between an individual terminal and the surrounding areas of the housing will alternate in opposite directions back-and-forth along the length of the housing, within the slot, as daughter board 11 biases the spring contact portions 34 of the terminals outwardly in alternating opposite directions.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A push-pull edge connector for mounting to a mother board and for receiving an edge of a daughter board having a mating edge and a plurality of contact pads on opposite sides of the board adjacent the edge, said contact pads of each side being offset parallel to said edge with respect to the contact pads of the other side, said connector comprising:

an elongated dielectric housing including a board-receiving slot therein for receiving the mating edge of the daughter board in an insertion direction, a pair of opposed side walls defining said board receiving slot, a bottom wall extending between said side walls, a plurality of terminal receiving cavities evenly spaced along and in communication with said slot, each said cavity extending downward from an upper surface of said housing and having a recess in said bottom wall and an aperture through said bottom wall, said recess and said aperture of each cavity being positioned on opposite sides transversely relative to said slot, and each said recess and each said aperture being generally adjacent a respective sidewall, said terminal receiving cavities being oriented in an alternating array in said housing so that the recesses of adjacent cavities are located on opposite sides of the board receiving slot and adjacent opposite side walls;

a plurality of blanked terminals mounted on the housing in said cavities, each terminal including a side support portion secured in said recess, a terminating portion spaced from said side support portion and projecting through said aperture for securement to said mother board;

a cross brace portion extending between the side support portion and the terminating portion, a spring contact arm projecting above the cross brace portion and having a contact portion for slidingly engaging one contact pad on only one side of the daughter board during insertion of a daughter board into said slot, the spring contact arm extending from one side of said slot and across the slot with said contact portion engaging a contact pad on an opposite side of a daughter board inserted into the slot;

the terminals being oriented in an alternating array along the slot of the elongated housing so that the contact portions of the terminals alternatingly engage contact pads on opposite sides of a daughter board inserted into said slot; and wherein an upwardly facing surface of the bottom wall supportingly engages the underside of the cross brace portion of each terminal to resist rotational movement of the terminal as a daughter board inserted into the slot biases the spring contact portion transversely of the slot.

2. The edge connector of claim 1 wherein said upwardly facing surface of the bottom wall supportingly engages substantially the entire length of the underside of the cross brace portion of each terminal.

3. The edge connector of claim 1 wherein said side support portion and said terminating portion are oriented so as to be generally parallel to said insertion direction of said daughter board.

4. The edge connector of claim 1 in which each terminal further includes at least one upwardly extending leg projecting above the cross brace portion, and the spring contact arm of the terminal extending from the one leg, above the cross brace portion and across the slot.

5. The edge connector of claim 2 wherein each said terminal includes an upwardly projecting leg at each end of the cross brace portion and extending above the cross brace portion of the terminal for facilitating top loading of the terminal into the housing through the slot.

6. The edge connector of claim 1 wherein each terminal further includes at least one upwardly extending leg projecting above the cross brace portion.

7. The edge connector of claim 3 wherein each said terminal includes an upwardly projecting leg at each end of the cross brace portion and extending above the cross brace portion of the terminal for facilitating top loading of the terminal into the housing through the slot.

8. The edge connector of claim 5 wherein the spring contact arm extends from one of the legs, above the cross brace portion and across the slot.

9. A push-pull edge connector for a printed circuit board having a mating edge and a plurality of contact pads on opposite sides of the board adjacent the edge, said contact pads of each side being offset with respect to the contact pads of the other side, said connector comprising:

an elongated dielectric housing having a board-receiving slot for receiving the mating edge of the printed circuit board in an insertion direction and a plurality of terminal receiving cavities generally perpendicular to and spaced along said slot, each said cavity having spaced apart, opposite ends adjacent side walls of said housing that define said slot;

a plurality of blanked terminals mounted on the housing seriatim along the slot in said cavities, each terminal including first and second spaced apart side support portions, said first side support portion being fixed to the housing at one end of each cavity and said second side support portion being fixed to said housing at said opposite end of said cavity, a cross brace portion extending between the first and second side support portions, a tail portion projecting from said housing for fixing to a complementary circuit component, and a spring contact arm projecting above the cross brace portion and including a contact portion for slidingly engaging one of the contact pads on one side of the printed circuit board upon insertion of a printed circuit board into the slot, the spring contact arm extending from adjacent the intersection of said first side support portion and the cross brace portion, and across the slot with the contact portion thereof engaging a contact pad on an opposite side relative to said first side support portion of a printed circuit board inserted into the slot, and the second side support portion extending beneath said cross brace;

the terminals being oriented in an alternating array along the slot of the elongated housing whereby the spring contact arms of the terminals alternatingly engage contact pads on opposite sides of the printed circuit board;

the housing including an area supportingly engaging the underside of the cross brace portion of each terminal and an opening supportingly engaging the second side support portion that extends below the cross brace to resist rotational movement of the terminal as the printed circuit board inserted into the slot biases the spring contact arm transversely of the slot.

10. The edge connector of claim 9 wherein said area of the housing that supportingly engages the underside of the cross brace portion of each terminal substantially engages the entire length of the underside of the cross brace portion.

11. The edge connector of claim 9 wherein said side support portions are oriented so as to be generally parallel to said insertion direction of said printed circuit board.

12. A push-pull connector for use with a printed circuit board having a mating edge and a plurality of contact pads on opposite sides of the board adjacent the edge, said contact pads of each side being offset with respect to the contact pads of the other side, said connector comprising:

an elongated dielectric housing having a board-receiving slot for receiving the mating edge of the printed circuit board in an insertion direction, and a plurality of terminal receiving cavities generally perpendicular to and spaced along said slot,;

a plurality of blanked terminals mounted in said cavities on the housing, each terminal including a pair of spaced apart, side support portions fixed to the housing and generally positioned at opposite sides of its respective cavity, a linear cross brace portion extending transversely to said insertion direction across said terminal receiving cavity and between the side support portions, a terminating portion projecting below the cross brace portion for rigid securement to a complementary circuit component, and a spring contact arm portion projecting above the cross brace portion and including a contact portion for engaging one of the contact pads on the printed circuit board, the spring contact arm extending from one of said side support portions and across the slot with said contact portion engaging a contact pad on an opposite side relative to said one of said side support portions of the printed circuit board inserted into the slot;

the terminals being oriented in an alternating array along the slot of the elongated housing whereby the contact portions of the terminals alternatingly engage contact pads on opposite sides of the printed circuit board;

the housing including an area supportingly engaging substantially the entire length of the underside of the cross brace portion of each terminal to resist rotational movement of the terminal as the printed circuit board inserted into the slot biases the spring contact portion transversely of the slot; and the housing and terminals being configured so that said printed circuit board is inserted into said board receiving slot along a plane parallel to said slot.

13. The edge connector of claim 12 wherein said side support portions are oriented so as to be generally parallel to said insertion direction of said printed circuit board.

14. The edge connector of claim 12 wherein said side support portions of each terminal comprise legs projecting below the cross brace portion of the terminal, the legs being fixed within holes in the housing.

15. The edge connector of claim 14 wherein at least one of said legs projects at least below a bottom surface of the housing to define said terminating portion of the terminal.

16. The edge connector of claim 14 wherein at least one of said legs projects above the cross brace portion, and the spring contact arm of the terminal extends from the one leg, above the cross brace portion, across the slot.

17. The edge connector of claim 16 wherein said at least one of said legs projects at least below a bottom surface of the housing to define said terminating portion of the terminal.

18. The edge connector of claim 14 wherein said legs project above the cross brace portion of the terminal for facilitating top loading of the terminal into the housing through the slot.

19. The edge connector of claim 18 wherein the spring contact arm extends from one of the legs, above the cross brace portion, across the slot.

20. The edge connector of claim 19 wherein said one leg projects at least below a bottom surface of the housing to define said terminating portion of the terminal.

* * * * *